US007716783B2

(12) United States Patent
DiPasquale et al.

(10) Patent No.: US 7,716,783 B2
(45) Date of Patent: May 18, 2010

(54) VACUUM HAVING INLET AND STORAGE FEATURES

(75) Inventors: Kathy E. DiPasquale, Baltimore, MD (US); Paul S. White, Towson, MD (US); Gregg L. Sheddy, Shrewsbury, PA (US); Michael P. Kunz, Hampstead, MD (US); Stuart J. Wright, Timonium, MD (US); Spencer G. Maid, Hartland, WI (US)

(73) Assignee: Black & Decker Inc., Newark, DE (US)

( * ) Notice: Subject to any disclaimer, the term of this patent is extended or adjusted under 35 U.S.C. 154(b) by 126 days.

(21) Appl. No.: 11/870,894

(22) Filed: Oct. 11, 2007

(65) Prior Publication Data

US 2008/0115312 A1 May 22, 2008

Related U.S. Application Data

(60) Provisional application No. 60/859,947, filed on Nov. 20, 2006, provisional application No. 60/896,580, filed on Mar. 23, 2007.

(51) Int. Cl.
*A47L 5/00* (2006.01)

(52) U.S. Cl. ..... 15/323; 15/327.1

(58) Field of Classification Search ..... 15/323, 15/327.1–327.7, 314, 324
See application file for complete search history.

(56) References Cited

U.S. PATENT DOCUMENTS

| | | | | |
|---|---|---|---|---|
| 2,699,838 | A | 1/1955 | Holm-Hansen | |
| 2,743,787 | A | 5/1956 | Seck | |
| 4,222,145 | A | 9/1980 | Lowder | |
| 4,563,789 | A | 1/1986 | Berfield | |
| 4,569,100 | A * | 2/1986 | Purkapile | 15/327.2 |
| 4,697,299 | A * | 10/1987 | Brinkhoff et al. | 15/323 |
| 4,716,620 | A * | 1/1988 | Hayashi et al. | 15/327.7 |
| 4,845,793 | A * | 7/1989 | Meyer | 15/328 |
| 4,910,828 | A * | 3/1990 | Blase et al. | 15/321 |
| 4,953,255 | A * | 9/1990 | Jenkins | 15/327.2 |
| 5,216,778 | A | 6/1993 | Suzuki et al. | |
| 5,408,722 | A | 4/1995 | Berfield | |
| 5,647,091 | A | 7/1997 | deBlois et al. | |
| 6,079,076 | A | 6/2000 | Berfield | |
| 6,195,835 | B1 * | 3/2001 | Song et al. | 15/327.1 |
| 6,484,350 | B2 * | 11/2002 | Yung | 15/327.1 |
| D467,694 | S | 12/2002 | Kitts | |
| 6,510,583 | B2 | 1/2003 | Griffin et al. | |
| 6,732,403 | B2 | 5/2004 | Moore et al. | |
| D525,000 | S | 7/2006 | Williams et al. | |
| 7,069,618 | B2 | 7/2006 | Valentini et al. | |

(Continued)

FOREIGN PATENT DOCUMENTS

| | | |
|---|---|---|
| DE | 1699438 U | 5/1955 |

(Continued)

*Primary Examiner*—Dung Van Nguyen
(74) *Attorney, Agent, or Firm*—Harness, Dickey & Pierce, P.L.C.

(57) ABSTRACT

A vacuum including a housing and a suction device disposed within the housing is provided with hose and power cord storage features. A pivotal inlet coupling facilitates storage of the hose. A separately formed inlet body facilitates easier formation of the inlet. A cord wrap feature allows easier storage and removal of the power cord.

10 Claims, 14 Drawing Sheets

U.S. PATENT DOCUMENTS

D528,255 S 9/2006 Griffin et al.

FOREIGN PATENT DOCUMENTS

EP 0232987 8/1987
FR 2425227 12/1979
GB 2341539 3/2000
GB 2402045 12/2004

* cited by examiner

VACUUM HAVING INLET AND STORAGE FEATURES

CROSS-REFERENCE TO RELATED APPLICATIONS

This application claims the benefit of U.S. Provisional Application No. 60/859,947 filed on Nov. 20, 2006 and U.S. Provisional Application No. 60/896,580 filed on Mar. 23, 2007. The disclosures of the above applications are incorporated herein by reference in their entirety.

FIELD

The present disclosure relates to vacuums, and in particular, to a vacuum with inlet and storage features.

BACKGROUND

The statements in this section merely provide background information related to the present disclosure and may not constitute prior art.

Many vacuum cleaners, especially shop vacuums, include a hose and a power cord that create storage issues with regard to providing neat methods of storing the power cord and hose on the vacuum. In addition, the vacuum can include accessories such as extensions to increase the reach of the vacuum, and a variety of nozzles and other attachments shaped to facilitate vacuuming on various surfaces and in tight spaces.

Typically, vacuums do not include satisfactory storage means for idle accessories. These vacuums fail to securely retain accessories in a space efficient manner. Accessories often must be stored separately from the vacuum, which requires the user to interrupt vacuuming to retrieve the accessories as needed.

SUMMARY

A vacuum includes a housing, a suction device disposed within the housing, a hose attached to the housing and in communication with the suction device, a plurality of wheels mounted to the housing and features for facilitating storage of the hose on the housing.

According to further aspects of the present disclosure, the vacuum housing can include additional features for storing the power cord and additional accessories.

According to yet another aspect of the present disclosure, the vacuum inlet is formed as a separate component that can be assembled to the vacuum canister. The inlet can be angled to direct debris away from the vacuum filter and to extend generally along a direct line to the user. The inlet can also provide a positive connection with the hose to facilitate the user moving the vacuum around by pulling on the hose. The inlet can also be made to pivot between a storage position to facilitate wrapping of the hose around the vacuum housing and a use position. The vacuum inlet can also facilitate connection of an optional filter bag.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
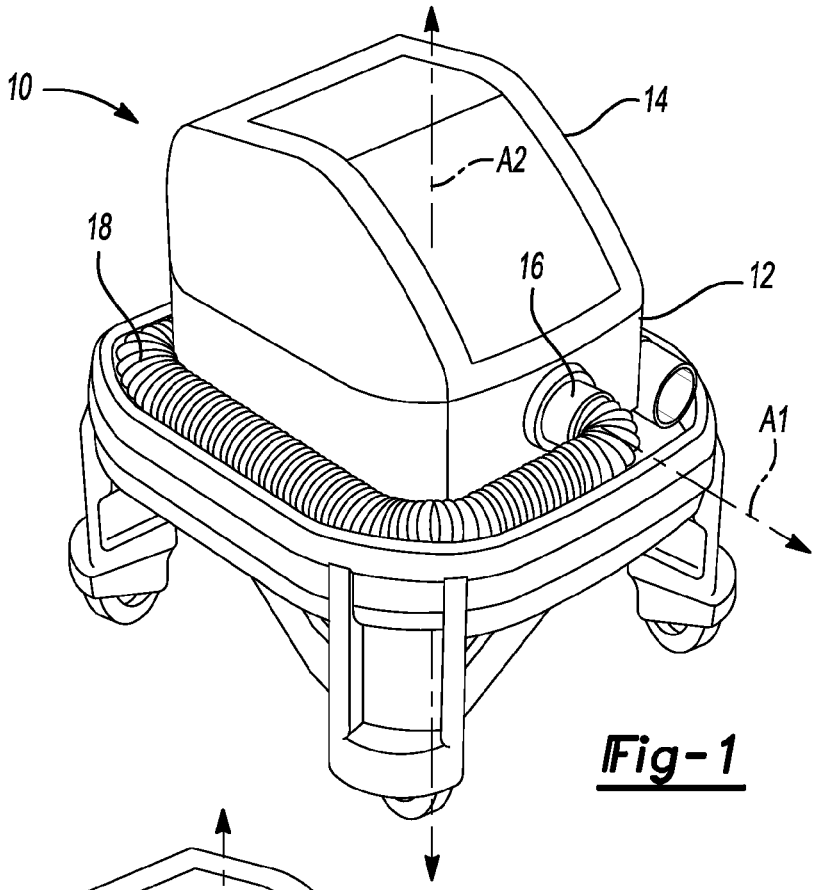
FIG. 1 is a perspective view of a vacuum according to the principles of the present disclosure with the hose in a stored position.

The following description is merely exemplary in nature and is not intended to limit the present disclosure, application, or uses. It should be understood that throughout the drawings, corresponding reference numerals indicate like or corresponding parts and features.

Figure 2:
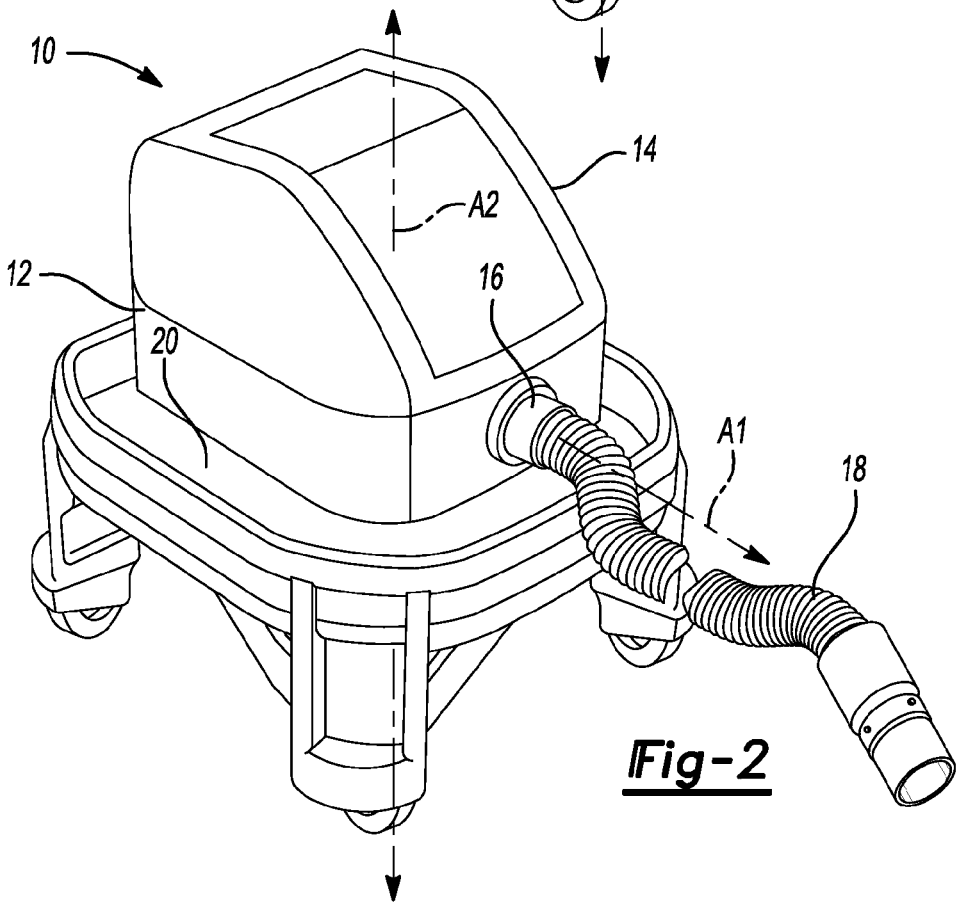
FIG. 2 is a perspective view of the vacuum of FIG. 1 with the hose in a use position.

With reference to FIGS. 1 and 2, a vacuum 10 is shown including a canister 12 and a head 14 that closes the canister 12. The canister 12 may include an inlet 16 that extends in generally perpendicular fashion from the canister 12. For example, the center axis A1 of the inlet 16 and the center axis A2 of the canister 12 may intersect at a right angle. The inlet 16 may be connected to a hose 18. FIG. 1 depicts the hose 18 in a stored condition, in which the hose 18 may be wrapped around the canister 12. The canister 12 includes a recessed groove 20 for receiving the hose 18 therein. FIG. 2 depicts the hose 18 in a usable condition, in which the hose 18 is removed from the groove 20 and extends from the canister 12. In both conditions, the connection between the hose 18 and the inlet 16 remain in a fixed orientation relative to the canister 12, which may eventually lead to fatigue failures.

Figure 3:
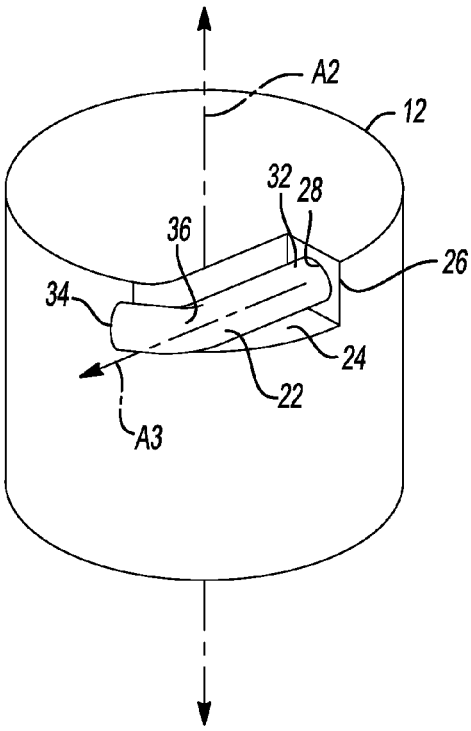
FIG. 3 is a perspective view of a vacuum canister according to the principles of the present disclosure with the hose inlet pivoted to a stored position.
Figure 4:
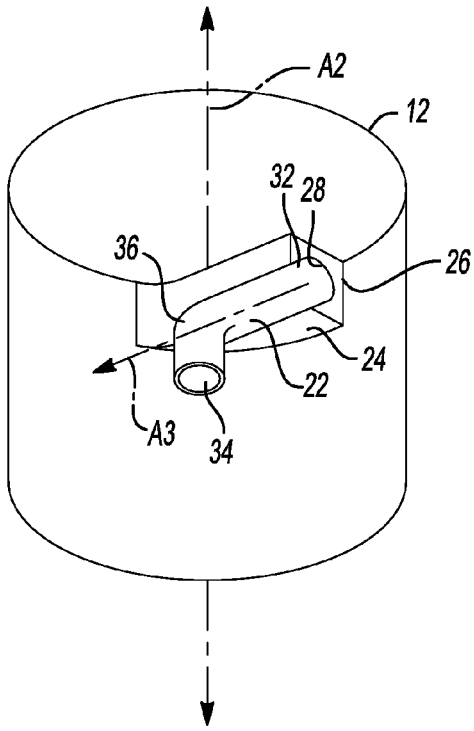
FIG. 4 is a perspective view of the vacuum canister of FIG. 3 with the hose inlet pivoted to a use position.

To reduce stress and fatigue that may occur in the hose 18 and/or in the inlet 16, example non-limiting embodiments of the disclosure may include a hose 18 mounted on a vacuum via a multi-position coupling 22. By virtue of the multi-position coupling 22, the orientation of the hose connection may be varied to facilitate hose storage and usage. With reference to FIGS. 3-6, an example coupling 22 that may be mounted on a canister 12 of a vacuum as shown. With reference to FIGS. 3 and 4, the canister 12 may include a recess 24 having a wall portion 26 defining an inlet 28. The inlet 28 may include an opening leading into the interior of the canister 12. By way of example only, a center axis A3 of the inlet 28 and a center axis A2 of the canister 12 may be perpendicular to each other and without intersecting each other.

The multi-position coupling 22 may be a tubular member including a proximate end 32 connected to the inlet 28 and a distal end 34 for connecting to a hose. The multi-position coupling 22 may include a bend 36 so that the proximate end 32 and the distal end 34 lie in intersecting planes. In the example embodiment, the coupling 22 may include a longitudinal profile with a single bend 36. The curvature of the bend may be varied. In alternative embodiments, the coupling 22 may include more than one bend.

By way of example only, the coupling 22 may have a uniform, circular, cross-sectional shape. It will be readily apparent that a coupling 22 having an alternative geometric cross-sectional shape other than a circular cross-sectional shape (may be suitably implemented). Moreover, the cross-sectional shape of the coupling may be varied along the length of the coupling 22.

The proximate end 32 of the coupling 22 may be mounted for rotation on the inlet 28 so that the coupling 22 may be rotated relative to the canister 12 between a hose storage position as shown in FIG. 3 and a hose use position as shown in FIG. 4. Numerous and varied mounting structures may be suitably implemented to facility the desired relative rotation between the coupling 22 and the canister 12. By way of example only, the proximate end 32 of the multi-position coupling 22 may have an inner surface with a groove that receives a flange projecting from the inlet 28. Thus, as the coupling 22 rotates relative to the inlet 28, the flange may slide through and be guided by the groove in the coupling 22. The length of the groove may limit the rotational movement of the coupling 22.

Figure 5:
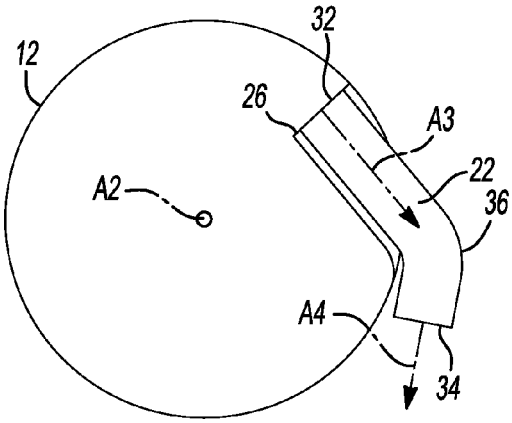
FIG. 5 is a schematic view of the inlet of the vacuum shown in FIG. 3 with the hose inlet pivoted to a stored position.
Figure 6:
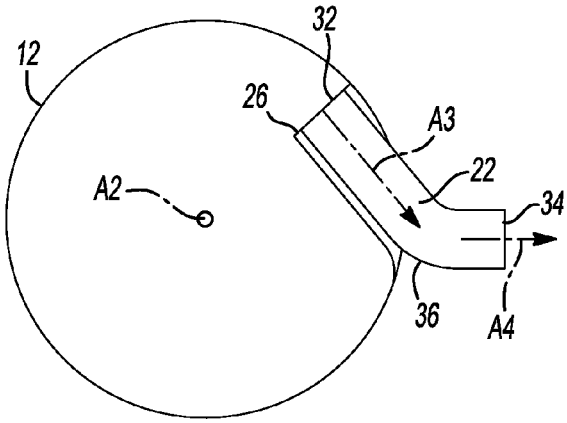
FIG. 6 is a schematic view similar to FIG. 5 with the hose inlet pivoted to a use position.

In the hose storage position, as shown in FIGS. 3 and 5, the coupling 22 may be oriented so that the bend 36 extends toward the canister 12. In this configuration, as shown in FIG. 5, the axis A4 of the distal end 34 of the coupling 34 may be generally tangent to an imaginary circle centered on the axis A2 of the canister 12. In the hose use position, as shown in FIGS. 4 and 6, the coupling 22 may be oriented so that the bend 36 extends away from the canister 12. As illustrated in FIG. 6, the axis A4 of the distal end 34 of the coupling 22 and the center axis A2 of the canister 12 may generally intersect at a right angle.

The coupling 12 may be rotated between the hose storage position and the hose use position without having to remove the coupling 22 from the inlet 28. For example, the coupling 22 may be rotated clockwise from the hose storage position shown in FIGS. 3 and 5 to the hose use position shown in FIGS. 4 and 6. During this rotational movement, the distal end 34 of the coupling 22 may travel along a semi-circular path unobstructed by the canister 12.

As noted above, the distal end 34 of the coupling 22 may be connected to a hose such as hose 18. The connection between the distal end 34 and the hose 18 may be achieved via a conventional friction fit. The coupling 22 can be readily rotated to the hose storage position to facility wrapping of the hose around the canister 12. A user may also rotate the coupling 22 to the hose use position to facilitate extending the hose from the canister 12.

Figure 7:
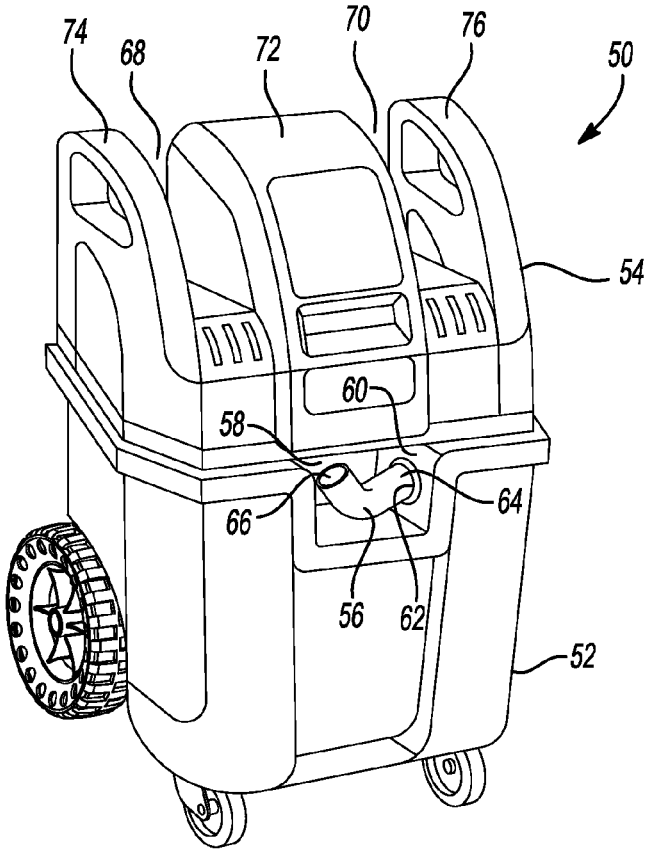
FIG. 7 is a perspective view of a vacuum according to the principles of the present disclosure with the hose inlet pivoted to a stored position.
Figure 8:
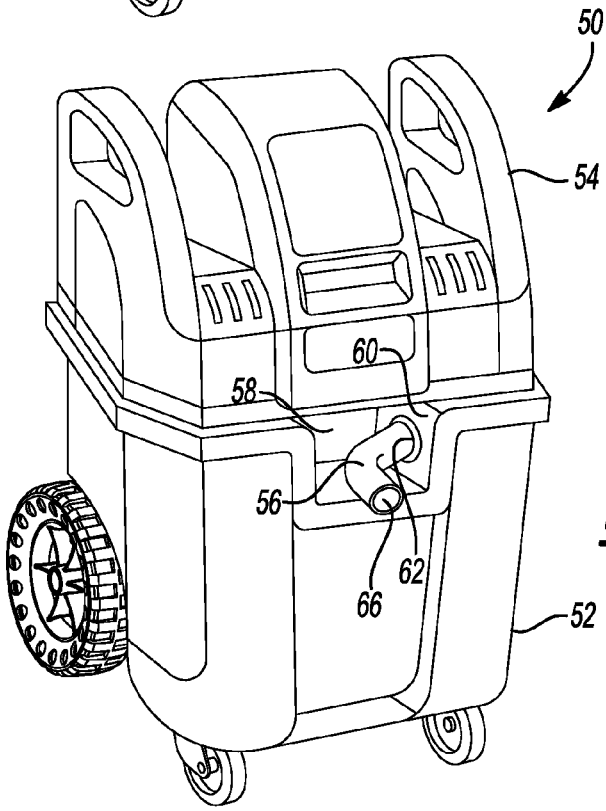
FIG. 8 is a perspective view of the vacuum of FIG. 7 with the hose inlet pivoted to a use position.
Figure 9:
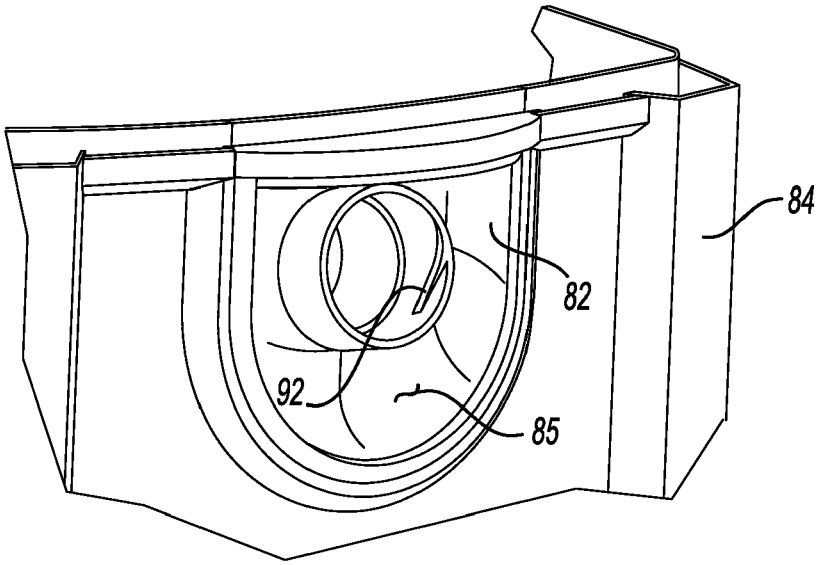
FIG. 9 is an exploded perspective view of a vacuum inlet disassembled from the vacuum canister according to the principles of the present disclosure.
Figure 10:
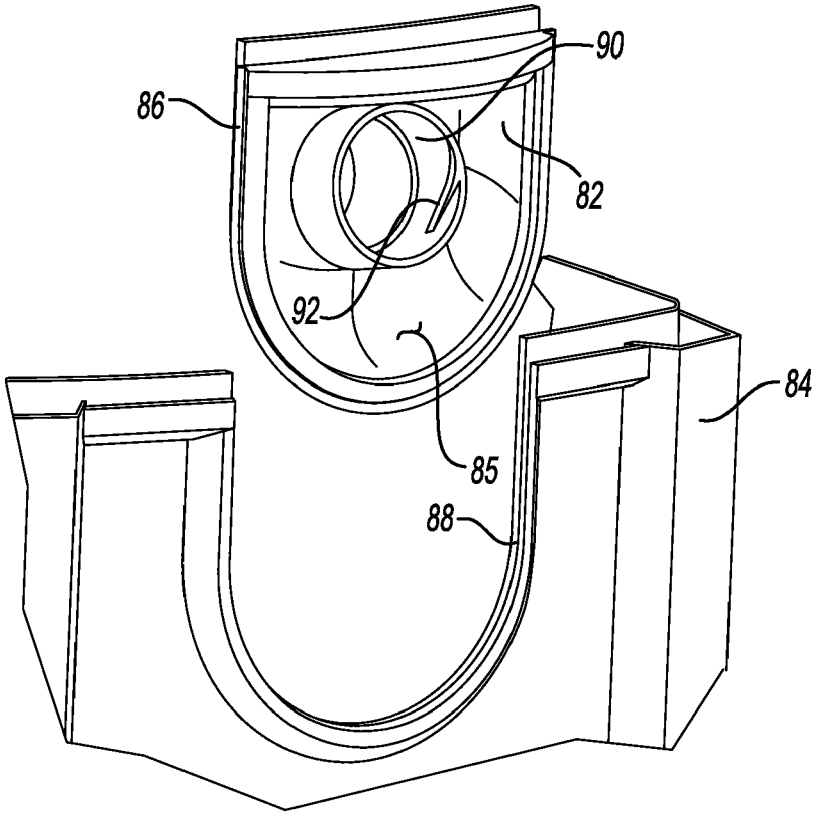
FIG. 10 is a perspective view of a vacuum inlet of FIG. 9 assembled to the vacuum canister according to the principles of the present disclosure.

A further example embodiment is depicted in FIGS. 7 and 8. With reference to FIG. 7, the vacuum 50 may include a canister 52, a head 54, and a multi-position coupling 56. The canister 52 may include a recess 58. A wall 60 of the recess 58 defines an inlet opening 62 leading into the interior of the canister 52.

The multi-position coupling 56 may be a tubular member including a proximate end 64 connected to the inlet 62 and a distal end 66 for connecting to a hose. The proximate end 64 of the multi-position coupling 56 may be mounted for rotation on the inlet 62 so that the coupling 56 may be rotated relative to the canister 52 between a hose storage position as shown in FIG. 7 and a hose use position as shown in FIG. 8. In the hose storage position, as illustrated in FIG. 7, the coupling 56 may be oriented so that the distal end 66 faces upward and toward the head 54. In the hose use position as illustrated in FIG. 8, the coupling 56 may be oriented so that the distal end 66 faces forward and away from the canister 12. In the embodiment of FIGS. 7 and 8, the user may rotate the coupling 56 to the hose storage position, as shown in FIG. 7, to facilitate wrapping of the hose around the head 54 by way of example only, wrapping main valve placing the hose in channels 68, 70 between the central portion 72 of the head 54 and handles 74, 76 of the head 54. A user may also rotate the coupling 56 to the hose use position as illustrated in FIG. 8 to facilitate extending the hose from the canister 52. In the example embodiments, the coupling may assume two positions, inclusive of the hose storage position and hose use position. In alternative embodiments, the coupling may assume more than two functional positions. For example, the coupling may also be used in combination with additional couplings, unions, and/or fittings to achieve additional hose connection orientations.

In the example embodiments, the coupling may be of a unitary, one piece, construction. In alternative embodiments, the coupling may include separate and distinct parts assembled together. For example, a first coupling part may be mounted for rotation on the inlet, and a second coupling part may be mounted for rotation on the first coupling part. By virtue of the multi-position coupling, a vacuum may achieve more compact hose storage and/or improve the life of the hose and/or the inlet.

Figure 11:
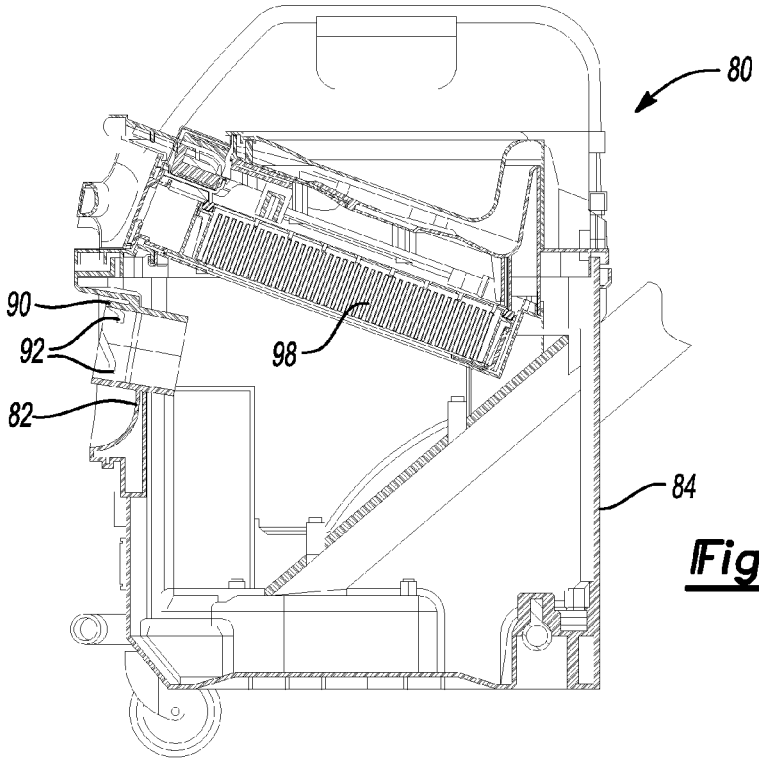
FIG. 11 is a cross-sectional view of the vacuum of FIG. 9 illustrating an angled inlet according to the principles of the present disclosure.
Figure 12:
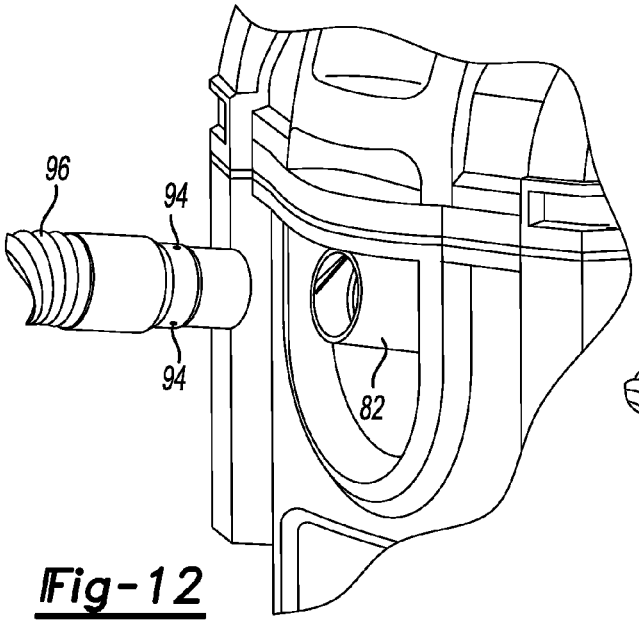
FIG. 12 is an exploded perspective view of a hose being connected to the hose inlet of the vacuum according to the principles of the present disclosure.
Figure 13:
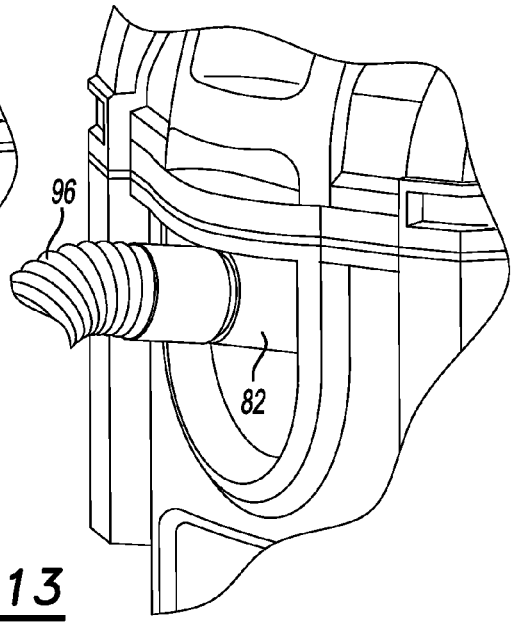
FIG. 13 is a perspective view similar to FIG. 12, illustrating the hose connected to the hose inlet of the vacuum.

With reference to FIG. 9-14, an alternative vacuum 80 having a hose inlet 82 assembled to the canister 84 will now be described. The hose inlet 82 can be a single piece assembled to the vacuum canister 84 in the manner illustrated in FIGS. 9 and 10. The hose inlet 82 can include a body 85 having a perimeter flange 86 that is received by the canister 84 in an air-tight condition. The flange 86 can be adhered to, or otherwise removably affixed, to a corresponding receiving slot 88 of the canister 84. The hose inlet body 85 supports a cylindrical inlet 90 extending through the body 85 so as to communicate between the exterior and interior sides of the canister 84. The cylindrical inlet 90 can be provided with interior locking features 92 that can mate with corresponding exterior locking features 94 provided on a vacuum hose 96 as illustrated in FIG. 12. The locking features 92, 94 provide a positive connection for the vacuum hose to prevent the vacuum hose 96 from being inadvertently pulled out of the cylindrical inlet 90 when a user pulls on the vacuum hose 96. FIG. 13 shows the vacuum hose 96 positively connected to the hose inlet 82.

As best illustrated in FIG. 11, the cylindrical inlet 90 is canted in a downward direction so as to direct air and debris away from the filter 98 disposed within the vacuum 80. The angled orientation of the inlet 90 also allows the hose to project upward from the exterior surface of the canister 84 toward a user who would otherwise normally pull upward on the hose in a use position and thereby create undesirable stresses and fatigue on the hose 96 and inlet 90. With the angled orientation of the cylindrical inlet 90, the hose naturally extends upward towards the user's use position thereby reducing the amount of strain and fatigue on the hose 96 and inlet 90.

Figure 14:
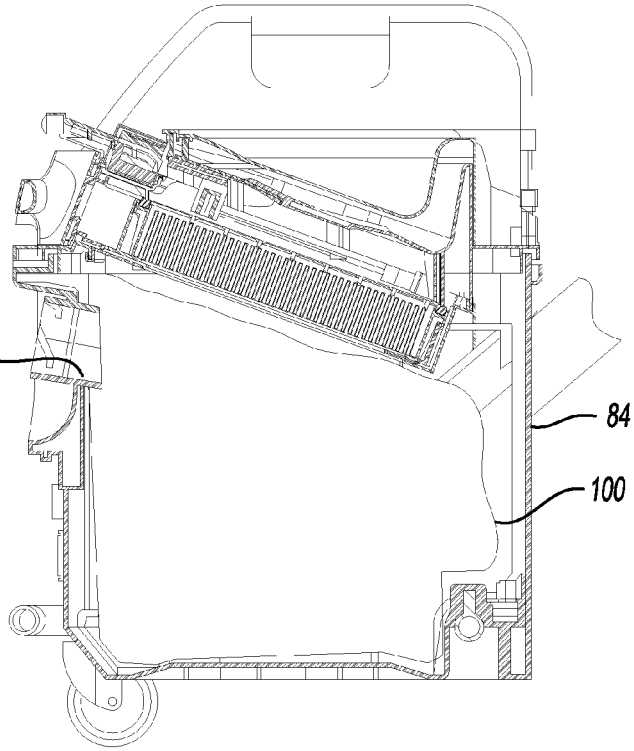
FIG. 14 is a cross-sectional view of the vacuum of FIG. 9 illustrating an optional filter bag connected to the hose inlet on an interior of the canister according to the principles of the present disclosure.

With reference to FIG. 14, an additional feature of the hose inlet 82, according to the principles of the present disclosure, is that the cylindrical inlet 90 extending into the interior of canister 84 provides a connection point for an optional vacuum collection bag 100 (i.e., filter bag) to be connected around the cylindrical inlet 90 that extends inward to the canister 84. The filter bag 100 is provided as an additional option to facilitate easier removable of debris within the canister 84. The filter bag 100 can be clamped to the cylindrical inlet portion 90 by a clamp or elastic band or other known method for providing a sealed connection with the inlet 82. When the filter bag 100 becomes full, the bag can be easily removed and discarded without creating additional mess requiring clean-up. The inlet 82 can be removed from the canister 84 to facilitate changing of the filter bag 100.

Figure 15:
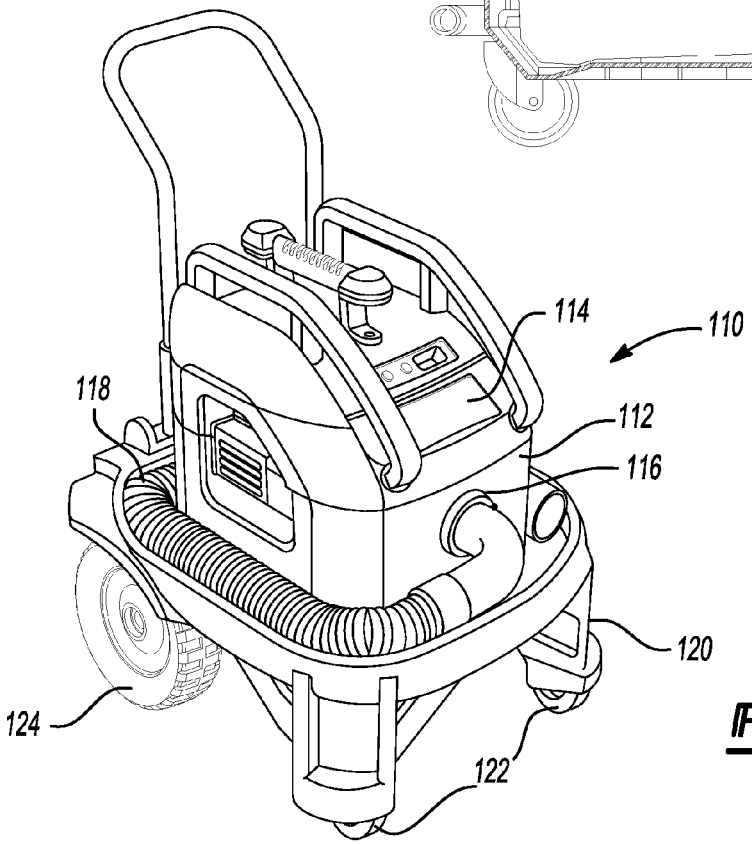
FIG. 15 is a perspective view of a vacuum according to the principles of the present disclosure with the hose in a stored position.
Figure 16:
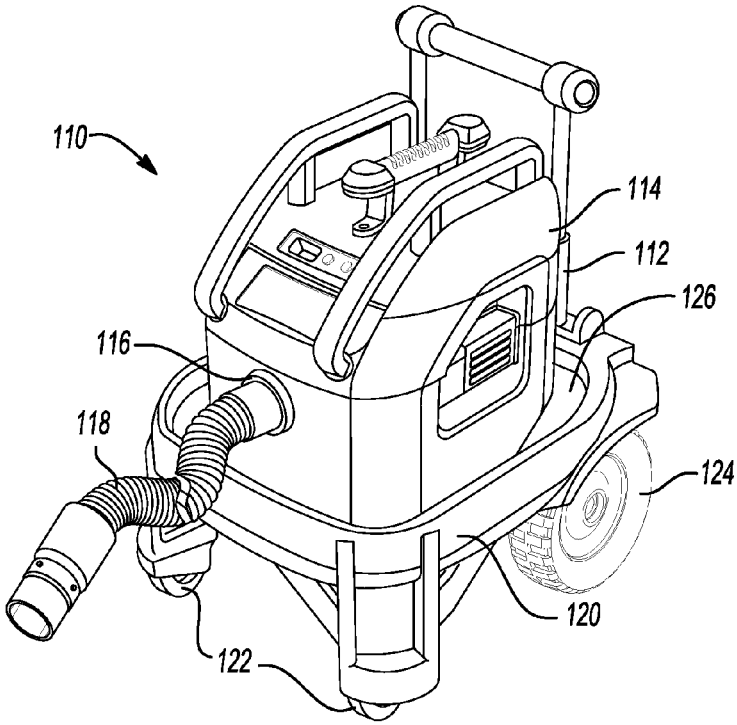
FIG. 16 is a perspective view of the vacuum of FIG. 15 with the hose in a use position.
Figure 17:
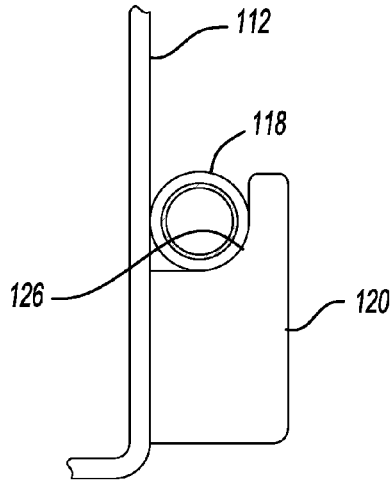
FIG. 17 is a partial cross-sectional view of the vacuum of FIG. 15 illustrating the channel for receiving the hose of the vacuum according to the principles of the present disclosure.

FIGS. 15-17 illustrate a vacuum 110 utilizing a storage groove 126 for receiving the hose 118 of the vacuum according to the principles of the present disclosure. The vacuum 110, as shown in FIGS. 15-17, includes a canister 112 and a head 114 mounted to the canister 112. The head 114 can include a vacuum source as is known in the art for creating a suction force to be applied to an inlet 116 provided in the canister 112. The hose 118 is connected to the inlet 116. The canister 112 is received in a support base 120 having a plurality of wheels such as caster wheels 122 and wheels 124 supported by an axle (not shown). The base 120 defines a recessed groove 126 extending around the periphery of canister 112 and adapted to receive the hose 118 therein, as illustrated in the cross-sectional view of FIG. 17.

Figure 18:
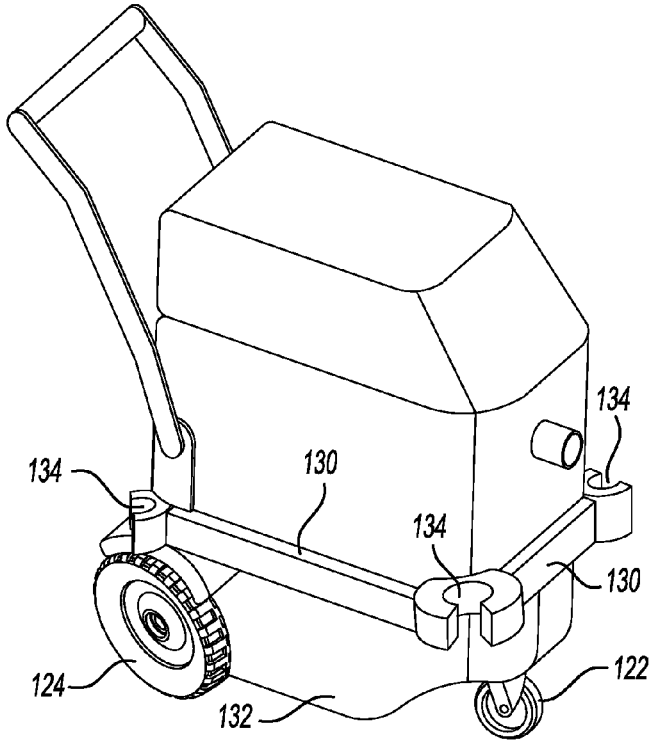
FIG. 18 is a perspective view of a vacuum according to an alternative embodiment of the present disclosure.
Figure 19:
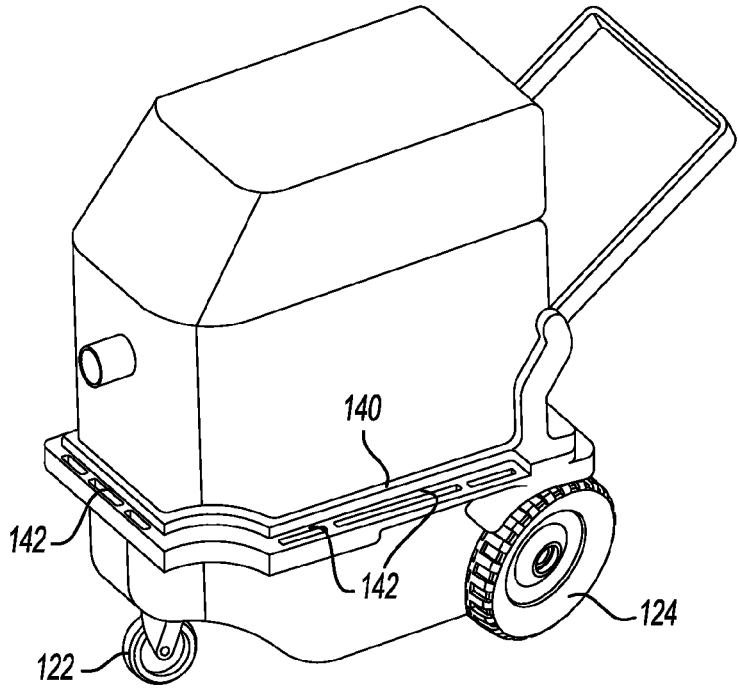
FIG. 19 is a perspective view of a vacuum according to an alternative embodiment of the present disclosure.

The support base 120 can further be designed to support one or more accessories as illustrated in FIGS. 18 and 19. In particular, in the embodiment shown in FIG. 18, the vacuum includes a base structure 130 surrounding the canister 132 that may be provided with apertures 134 for receiving one or more accessories. The apertures 134 can be provided in addition to a recess groove 126 for receiving the hose. Furthermore, as illustrated in FIG. 19, a base structure 140 can be provided including recesses 142 extending longitudinally therein for longitudinally receiving various vacuum accessories, including extension tubes and various nozzles.

Figure 20:
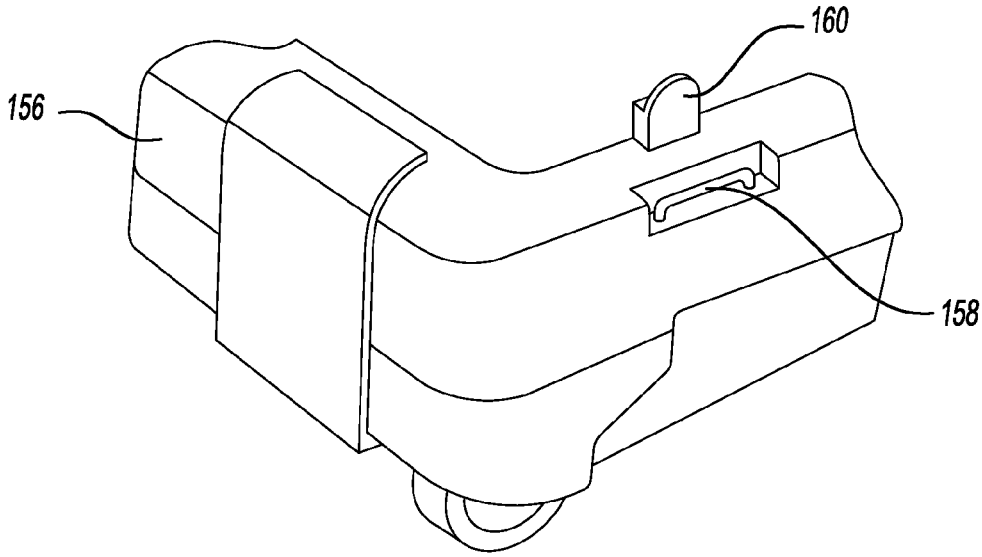
FIG. 20 is a close-up perspective view of a vacuum according to an alternative embodiment of the present disclosure.
Figure 21:
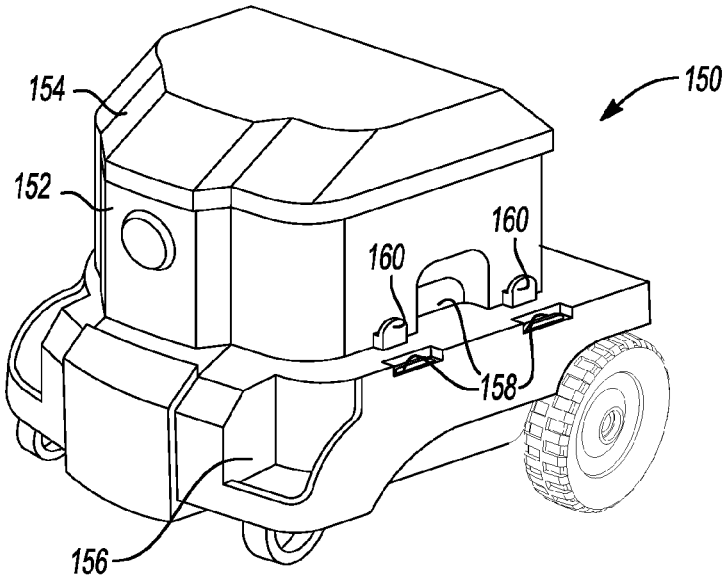
FIG. 21 is a perspective view of the vacuum shown in FIG. 20.
Figure 22:
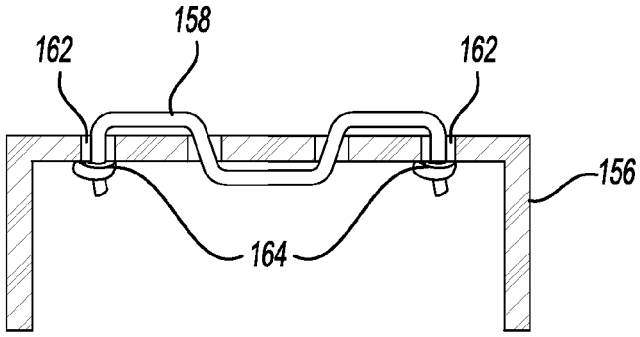
FIG. 22 is a cross-sectional view illustrating the connection of the bungee cord of the vacuum shown in FIG. 20.

With reference to FIGS. 20-22, a vacuum 150 including a canister 152 having a head 154 mounted thereto can include a support base 156 supporting the canister 152. The support base 156 can include one or more retaining cords 158 and one or more retaining clips 160. As shown in FIG. 20, the retaining clips 160 are disposed next to the retaining cords 158 wherein the vacuum hose or other accessories can be laid on top of the support base 156 and the retaining cord 158 can be stretched over top of the accessory or hose and engage with retaining clip 160 in order to secure the hose or accessory to the vacuum 150. As illustrated in FIG. 22, the support structure 156 can be provided with a plurality of apertures 162 through which the cord 158 can be inserted. The cord 158 can be provided with knots 164 at opposite ends thereof, or additional retaining features to prevent the ends of the cords from being pulled through the openings 162.

With respect to each of the embodiments disclosed in FIGS. 15-21, it should be understood that the vacuum canister can be removably disposed within the support structure so that the vacuum canister can be removed therefrom. It should be understood with respect to the embodiment of FIGS. 20-22, that the bungee cords can be replaced with other types of fasteners such as buttons, clips, hook-and-loop fasteners, separable fasteners, snaps, straps, ties, touch fasteners, zippers, or other devices that may facilitate retaining at least in part at least one accessory on the support base 156.

Figure 23:
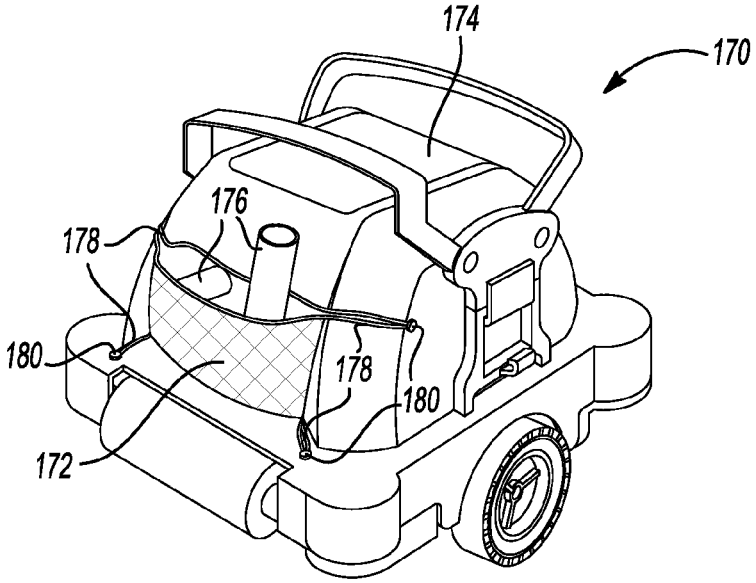
FIG. 23 is a perspective view of a vacuum according to an alternative embodiment of the present disclosure including an accessory storage net.

With reference to FIG. 23, a vacuum 170 is shown including a net 172 mounted to the housing 174 for securing a plurality of accessories 176 within the net. The accessories can include extension tubes and various nozzles and accessories. The net 172 can include a plurality of retaining straps 178 that can be hooked to hook features 180 provided on the housing 174 of the vacuum 170 for securing the net 172 in place. The net 172 can include a meshed net or can include a fabric enclosed pocket for receiving the accessories 176.

Figure 24:
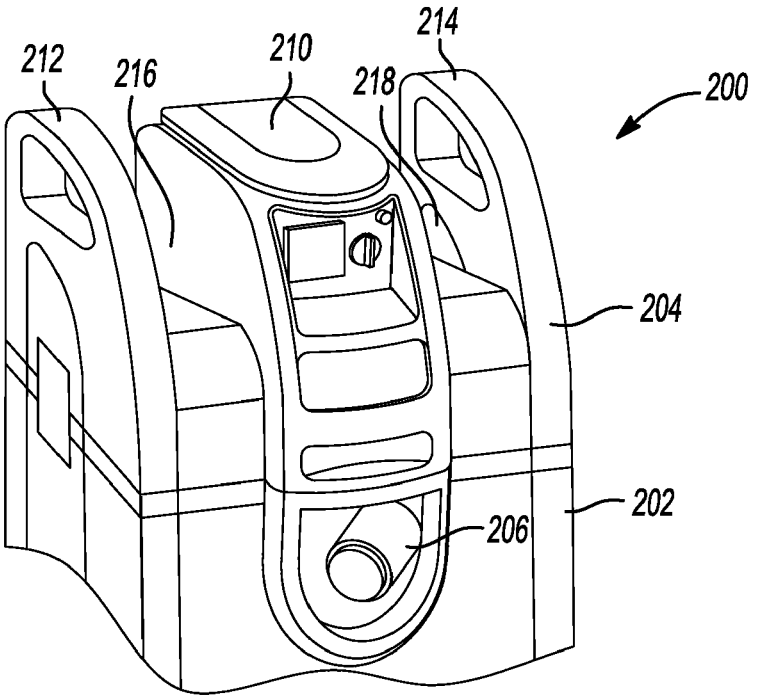
FIG. 24 is a perspective view of a vacuum according to an alternative embodiment of the present disclosure.
Figure 25:
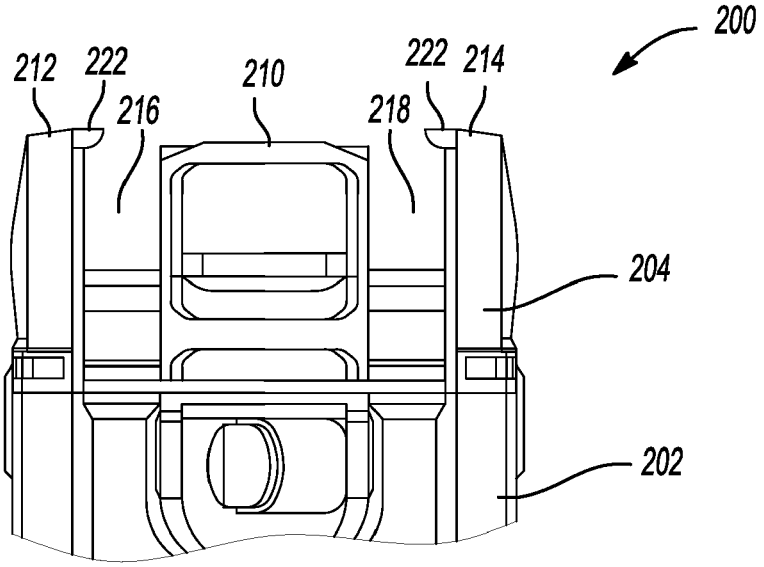
FIG. 25 is a front view of the vacuum shown in FIG. 24.
Figure 26:
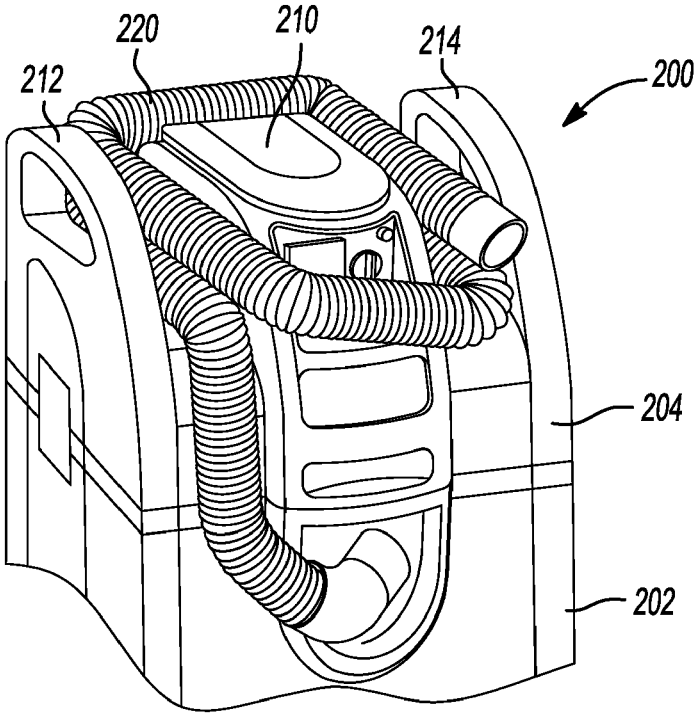
FIG. 26 is a perspective view of the vacuum shown in FIG. 24 with a hose stored on the vacuum.

With reference to FIGS. 24-32, a further vacuum 200 will now be described. The vacuum 200 includes a canister 202 having an open upper end enclosed by a head 204. The vacuum 200 can include an inlet 206 provided in the canister 202. The inlet 206 can be of the type described in FIGS. 9-14 and can further include a multi-position coupling as described with reference to FIGS. 3-8, herein. As illustrated in FIGS. 24-26, the head 204 of the vacuum 200 includes a central protruding portion 210 that generally houses the motor of the vacuum source and can include additional plug outlets and control switches therein for controlling operation of the vacuum 200. The head 204 also includes a pair of upwardly protruding side handles 212, 214 disposed on opposite sides of the central portion 210 and defining a pair of channels 216, 218 between the handle portions 212, 214 and the central portion 210. The channels 216, 218 define a space for receiving the hose 220 which can be wrapped around the central portion 210 in the channels 216, 218, as illustrated in FIG. 26. The handle 212, 214 can be provided with tabs 222 extending laterally inward into the channels 216, 218. The tabs 222 help to lock the hose 220 into the storage channels 216, 218. It should be noted that additional tabs can be disposed on the center portion 210 of the head 204 to further facilitate engagement of the hose 220 into the storage channels 216, 218.

Figure 27:
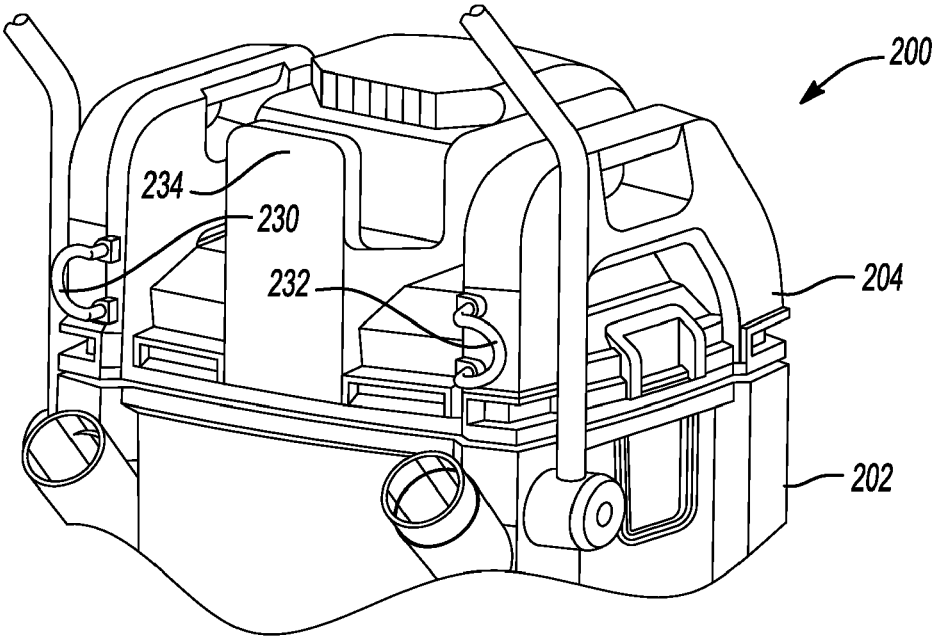
FIG. 27 is a rear perspective view of the vacuum shown in FIG. 24 illustrating power cord wrap features according to the principles of the present disclosure.
Figure 28:
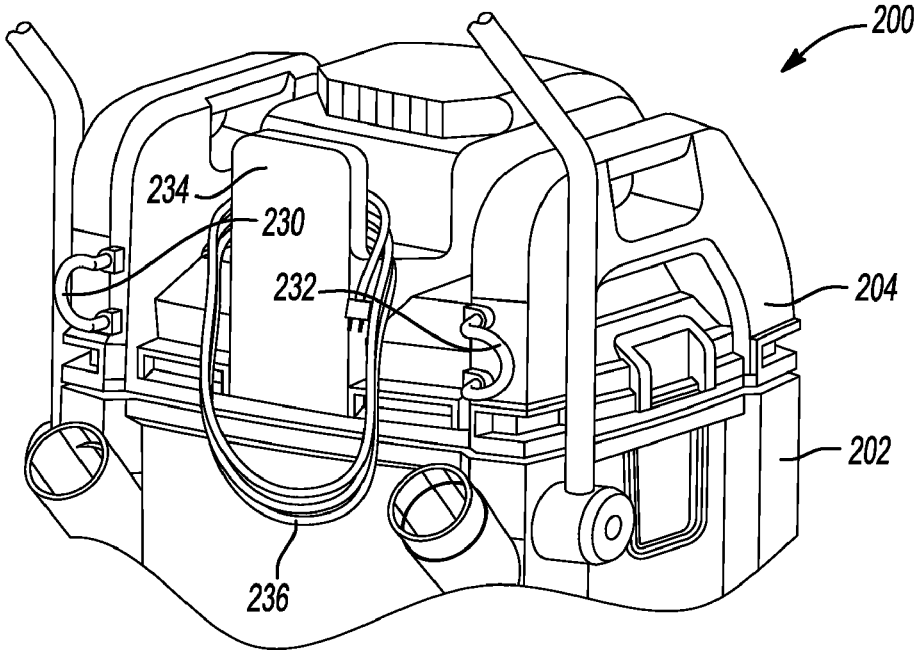
FIG. 28 is a rear perspective view of the vacuum shown in FIG. 24 illustrating a cord wrapped around a first cord wrap feature according to the principles of the present disclosure.
Figure 29:
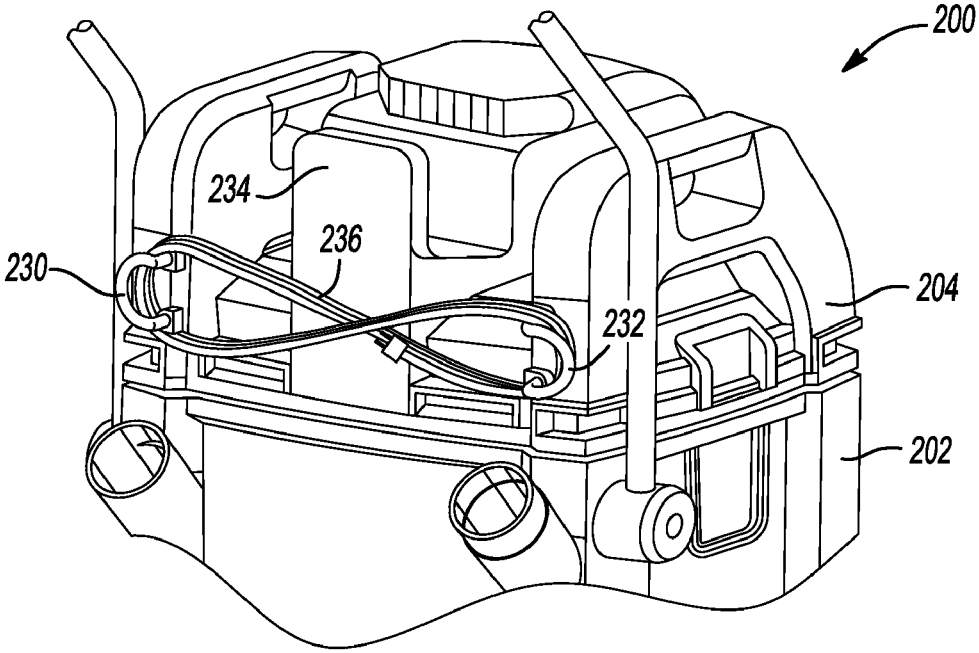
FIG. 29 is a rear perspective view of the vacuum shown in FIG. 24 illustrating a cord wrapped around a second cord wrap feature according to the principles of the present disclosure.

With reference to FIGS. 27-29, the vacuum 200 can be provided with a pair of cord wrap ears 230, 232 and a molded-in horn 234. The horn 234 can be utilized as illustrated in FIG. 28, to receive a cord that is looped around the horn and suspended thereby.

Figure 31:
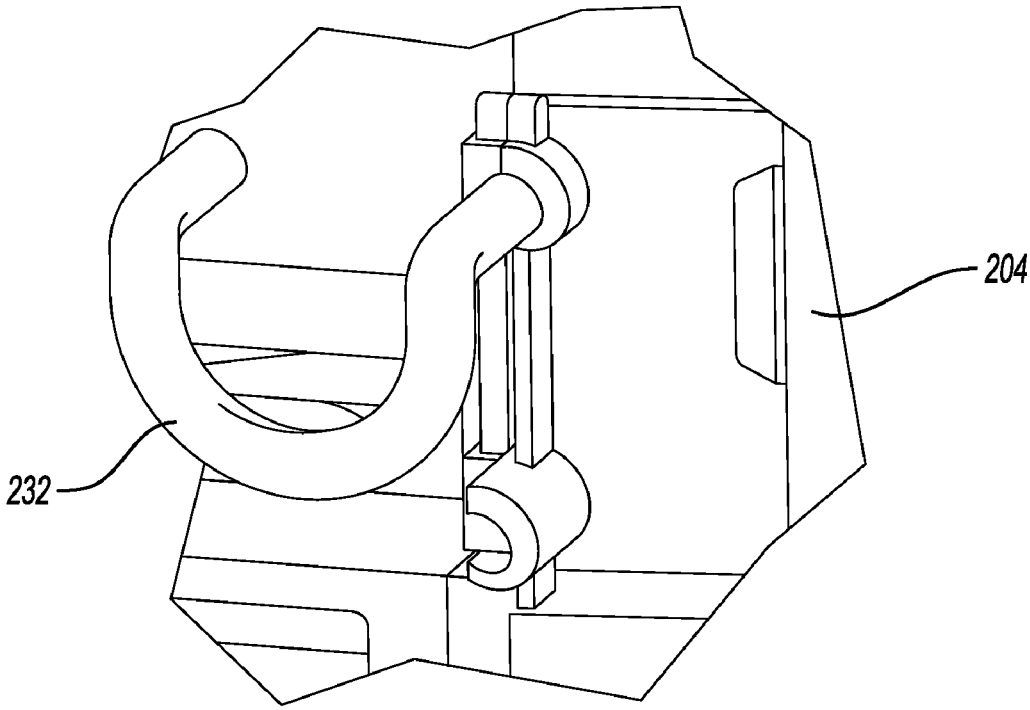
FIG. 31 is a close-up perspective view of the cord wrap feature shown in a release position according to the principles of the present disclosure.

As illustrated in FIG. 29, a cord can also be tightly wrapped around the ears 230, 232 as illustrated. In order to provide a quick release of the cord 236 which is wrapped around the ears 230, 232, the ears 230, 232 can be designed to be rotated 90 degrees to a release position as illustrated in FIG. 31. In the release position, as illustrated in FIG. 31, the cord 236 which is tightly wrapped around the ears 230, 232 can be disengaged from the ears without having to manually unwrap each of the wrappings of the cord 236 from the ears 230, 232.

Figure 30:
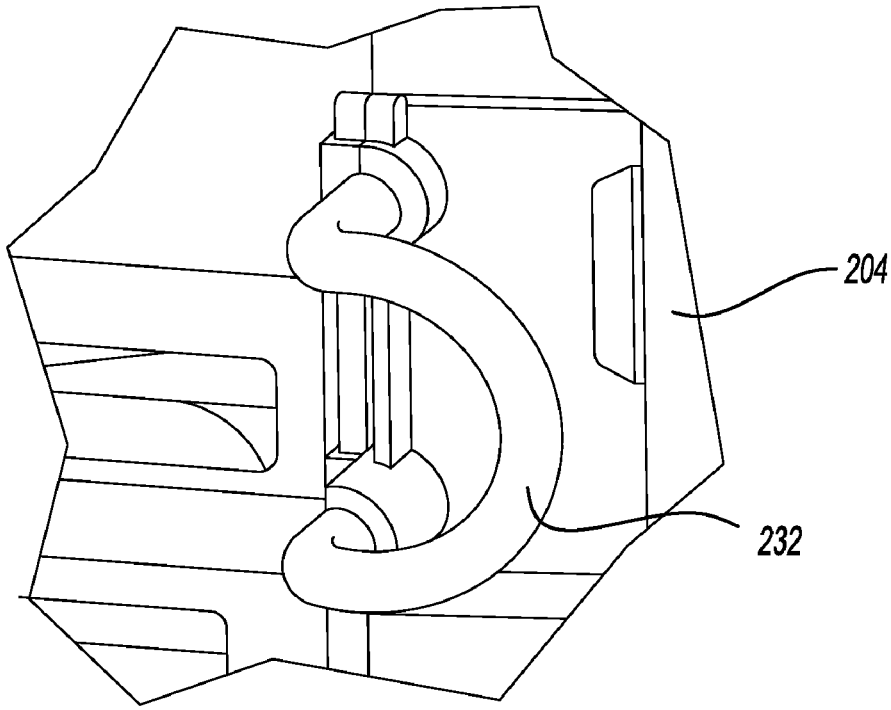
FIG. 30 is a close-up perspective view of the cord wrap features according to the principles of the present disclosure.
Figure 32A:
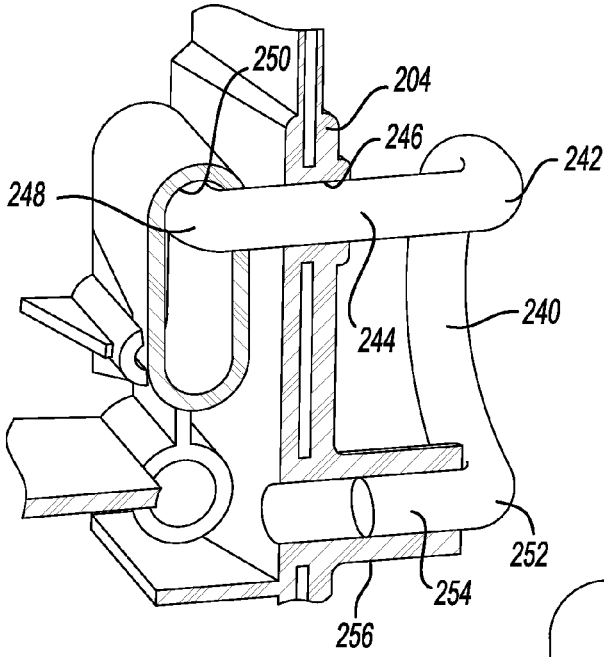
FIGS. 32A-32C illustrate operation of the cord warp feature.
Figure 32B:
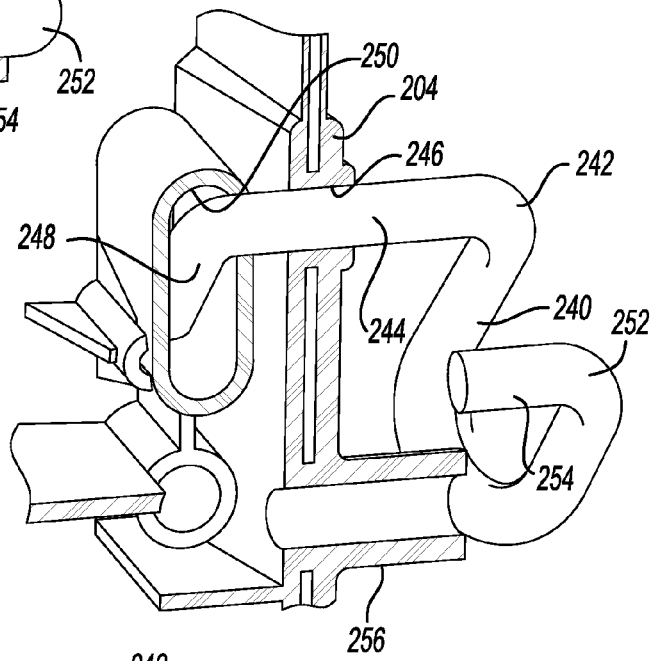

With reference to FIGS. 30-32, the operation of the ears 230, 232 will be described in further detail. The ears 232 can include a bent wire-form component that can be made from rigid wire, or alternatively, can be molded from plastic or other metals. For brevity sake, the operation of only one of the ears 230, 232 will be described. In the present description, ear 232 will be described in further detail. The ear 232 includes a generally U-shaped loop portion 240 having a first end 242 supported by a bent arm 244 extending generally perpendicular to the loop portion 240. The pivot arm 244 is received in an aperture 246 provided in the housing of the head 204. The pivot arm 244 terminates in a 90 degree bent arm 248 which is received in a limit channel 250 disposed on the interior side of the housing of the head 204. The U-shaped loop portion has a second end 252 including a bent arm 254 extending generally perpendicular to the end of the U-shaped loop portion 240, the arm 254 is received against an elongated boss 256 extending from the housing of the head 204.

Figure 32C:
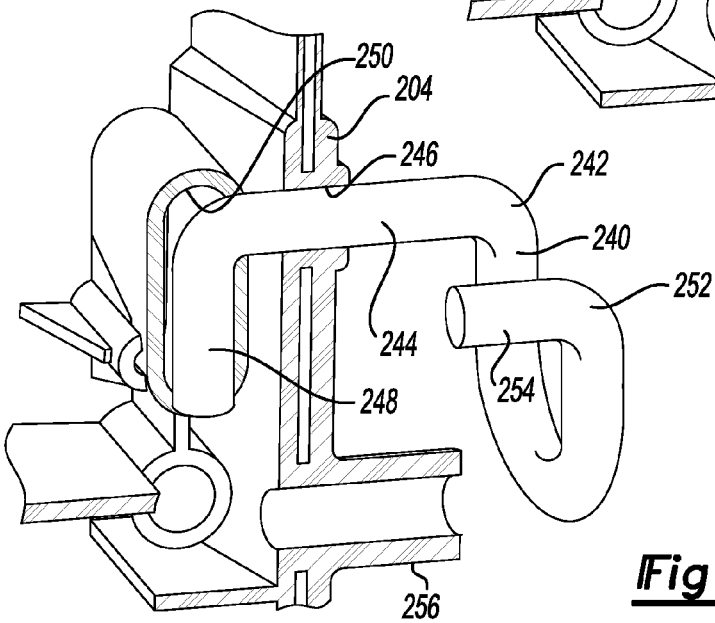

In the use position, as illustrated in FIGS. 30 and 32A, the arm 248 is disposed against the upper surface of the limit channel 250 and the arm 254 is disposed against the boss 256 and the U-shaped loop portion 240 extends laterally outward in an opposite direction from the loop portion of ear 230, in order to retain a power cord 236 thereon. The power cord 236 can be wrapped around the pivot arm 244 and against the boss 256 in the use position which isolates forces from being applied to the lower arm 254 of the ear 232. In order to quickly release the cord from its wrapped position, the ear 232 can be pivoted to the position as illustrated in FIG. 31 and FIG. 32C such that the loop portion 240 is moved toward ear 230 and extends downward from the pivot arm 244 and the cord can freely slide rearwardly off of the upper pivot arm 244 and the boss 256 to allow the power cord 236 to be easily removed. Removal of the power cord can be facilitated by one or both of the ears 230, 232 being mounted in the manner described herein. The use of a single pivoting ear 230 or 232 would also adequately allow removal of one end of the cord so that the second end can be easily removed.

The description of the present disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A vacuum comprising:

a housing;

a suction device disposed in said housing; and an inlet coupling pivotally mounted to said housing and having a hose mounted thereto, said inlet coupling being movable between a hose storage position and a use position, said inlet coupling having a tubular body including a bend therein such that a distal end of said inlet coupling is angled relative to a proximal end of said inlet coupling;

wherein in said storage position, said distal end of said coupling extends generally tangentially to an adjacent surface of said housing and in said use position, said distal end extends generally perpendicular to the adjacent surface of said housing.

2. The vacuum of claim 1, further comprising a handle extending from said head portion, said handle at least partially defining a channel for receiving said hose therein an a storage position.

3. A vacuum comprising:

a housing including a canister portion and a head portion disposed on said canister portion;

a suction device disposed in said housing; and an inlet coupling pivotally mounted to said canister portion and having a hose mounted thereto, said inlet coupling being movable between a hose storage position and a use position, said inlet coupling having a tubular body including a bend therein such that a distal end of said inlet coupling is angled relative to a proximal end of said inlet coupling;

wherein in said storage position, said distal end of said coupling extends toward said head portion and in said use position, said distal end extends away from said canister portion.

4. The vacuum according to claim 3, wherein said head portion includes at least one channel for receiving said hose therein in a storage position.

5. The vacuum of claim 4, further comprising a handle extending from said head portion, wherein said handle at least partially defines said channel.

6. The vacuum according to claim 3, wherein said inlet coupling is pivotally mounted to a wall of a recess in said canister portion.

7. The vacuum according to claim 6, wherein said recess is formed in an exterior surface of said canister portion.

8. The vacuum according to claim 7, wherein in said storage position, said distal end of said coupling is received within said recess and extends towards said head portion, and in said use position, said distal end of said inlet coupling protrudes from said recess and extends away from said canister portion.

9. A vacuum comprising:

a housing including a canister portion and a head portion, said head portion including a pair of channels for receiving a hose therein in a storage position;

a pair of handles extending from said head portion, said pair of handles at least partially defining said pair of channels;

a suction device disposed in said housing;

an inlet coupling pivotally mounted to said canister portion and having said hose mounted thereto, said inlet coupling being movable between a hose storage position and a use position, said inlet coupling having a tubular body including a bend therein such that a distal end of said inlet coupling is angled relative to a proximal end of said inlet coupling;

wherein in said storage position, said distal end of said coupling extends toward said head portion and in said use position, said distal end extends away from said canister portion.

10. The vacuum of claim 9, wherein said inlet coupling is pivotally mounted to a wall of a recess in said canister portion.

* * * * *